US010866543B2

(12) United States Patent
Hamana et al.

(10) Patent No.: US 10,866,543 B2
(45) Date of Patent: Dec. 15, 2020

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventors: Eiichi Hamana, Inagi (JP); Noriaki Egawa, Komae (JP); Kouichi Uchida, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/869,430

(22) Filed: May 7, 2020

(65) Prior Publication Data

US 2020/0363756 A1 Nov. 19, 2020

(30) Foreign Application Priority Data

May 16, 2019 (JP) ..... 2019-092980

(51) Int. Cl.
*G03G 15/16* (2006.01)

(52) U.S. Cl.
CPC ... *G03G 15/162* (2013.01); *G03G 2215/1623* (2013.01)

(58) Field of Classification Search
CPC ..... G03G 15/1605; G03G 15/162; G03G 15/2053; G03G 15/75; G03G 2215/00139; G03G 2215/00957; G03G 2215/1623; G03G 2215/2009; G03G 2215/2016
USPC ..... 399/162, 302, 308, 329
See application file for complete search history.

(56) References Cited

U.S. PATENT DOCUMENTS 5,733,694 A * 3/1998 Takehana ..... G03G 7/0046 428/480
5,780,192 A * 7/1998 O'Regan ..... G03G 5/056 430/59.6
5,978,639 A * 11/1999 Masuda ..... G03G 15/162 399/302
7,215,912 B2 * 5/2007 Yamaguchi ..... G03G 9/0819 399/302
10,377,152 B1 * 8/2019 Wu ..... B41J 11/0085
2006/0046169 A1 * 3/2006 Shoshi ..... G03G 5/0668 430/58.7

(Continued)

FOREIGN PATENT DOCUMENTS

JP 57161748 A * 10/1982 ..... G03G 5/0208
JP 2001154395 A * 6/2001
JP 2010-195957 A 9/2010

(Continued)

*Primary Examiner* — Robert B Beatty
(74) *Attorney, Agent, or Firm* — Canon U.S.A., Inc. IP Division

(57) ABSTRACT

An electrophotographic belt including an electro-conductive layer having high adhesion to a base layer while maintaining high electro-conductivity. The electrophotographic belt has an endless shape, and includes an endless shaped base layer containing a polyester resin, and an electro-conductive layer covering an inner surface of the base layer, the electro-conductive layer containing an electro-conductive particle and a binder resin, and the binder resin containing a polyester resin having at least two monomer units of phthalic acids selected from the group consisting of terephthalic acid, orthophthalic acid and isophthalic acid.

13 Claims, 2 Drawing Sheets

(56) References Cited

U.S. PATENT DOCUMENTS

| | | | | |
|---|---|---|---|---|
| 2008/0038658 | A1* | 2/2008 | Tanaka | G03G 15/0131<br>430/127 |
| 2008/0057419 | A1* | 3/2008 | Fujimoto | G03G 15/6591<br>430/32 |

FOREIGN PATENT DOCUMENTS

| | | | |
|---|---|---|---|
| JP | 2012-098709 | A | 5/2012 |
| JP | 2018-25621 | A | 2/2018 |
| JP | 2018-036624 | A | 3/2018 |
| WO | 2006/033471 | A1 | 3/2006 |

* cited by examiner

ELECTROPHOTOGRAPHIC BELT AND ELECTROPHOTOGRAPHIC IMAGE FORMING APPARATUS

BACKGROUND

The present disclosure relates to an electrophotographic belt used in an electrophotographic image forming apparatus (hereinafter, referred to as an "electrophotographic apparatus") such as a copying machine or a printer, and an electrophotographic image forming apparatus.

DESCRIPTION OF THE RELATED ART

In the electrophotographic apparatus, an electrostatic charge image carrying member such as a photosensitive drum is charged, and the charged electrostatic charge image carrying member is exposed to light, thereby forming an electrostatic latent image. Thereafter, the electrostatic latent image is developed by toner subjected to triboelectric charging, and a toner image is transferred and fixed onto a recording medium such as paper, thereby forming a desired image on the recording medium.

As a transfer system of the electrophotographic apparatus, an intermediate transfer system in which a non-fixed toner image on an electrostatic charge image carrying member such as a photosensitive drum is primarily transferred onto an intermediate transfer body by a current supplied from a transfer power supply; and then the non-fixed toner image is secondarily transferred onto a recording medium from the intermediate transfer body, has been used. For the primary transfer and the secondary transfer, transfer power supplies are installed, and are controlled so as to have an optimal current value depending on a surrounding environment (temperature and humidity) or a type of the recording medium. Such an intermediate transfer system is particularly adopted in a color electrophotographic apparatus.

In the color electrophotographic apparatus, four color toners (yellow, magenta, cyan, and black) are sequentially transferred onto the intermediate transfer body from image forming units of respective colors, and the obtained combined images are collectively transferred onto the recording medium. Therefore, it is possible to increase a printing speed and to obtain a high quality image.

In recent years, with increasing needs for miniaturization and cost reduction of a copying machine or a printer, reduction in the number of parts has been studied. Japanese Patent Application Laid-Open No. 2012-098709 discloses an electrophotographic image forming apparatus in which power supplies for a primary transfer and a secondary transfer are used in common so as to use an intermediate transfer body having electro-conductivity higher than that of the related art, and the primary transfer is performed by flowing a current from one transfer power supply in a circumferential direction of the intermediate transfer body.

Japanese Patent Application Laid-Open No. 2018-036624 discloses an electrophotographic image forming apparatus including a toner image carrying member that carries a toner image on an outer surface thereof, an intermediate transfer belt, a current supply member that is in contact with the intermediate transfer belt, and a power supply that applies a voltage to the current supply member. This electrophotographic image forming apparatus is an electrophotographic image forming apparatus in which the toner image is primarily transferred onto the outer surface of the intermediate transfer belt from the toner image carrying member by flowing a current in a circumferential direction of the intermediate transfer belt through the application of the voltage from the power supply to the current supply member. The intermediate transfer belt has a first layer having ion electro-conductivity (hereinafter, abbreviated to a "base layer"), and a second layer having electro-conductivity and an electric resistance lower than that of the first layer (hereinafter, abbreviated to an "electro-conductive layer").

According to studies conducted by the present inventors, it was recognized that, in a case where, by one transfer power supply, the primary transfer is performed by flowing a current in the circumferential direction of the intermediate transfer belt according to Japanese Patent Application Laid-Open No. 2018-036624, in order to enhance primary transferability, it is preferable that the electro-conductive layer contains more of an electronic electro-conductive agent. Specifically, for example, it is preferable that the electro-conductive layer contains 5 mass % or more of carbon black based on a mass of the electro-conductive layer.

However, when an electro-conductive layer contains a large amount of an electronic electro-conductive agent, a content ratio of a binder resin in the electro-conductive layer is relatively reduced, and adhesion of the electro-conductive layer to the base layer may thus be reduced. The reduction in adhesion of the electro-conductive layer to the base layer may cause separation of the electro-conductive layer from the base layer due to long-term use of the intermediate transfer belt.

SUMMARY OF THE INVENTION

An aspect of the present disclosure is directed to providing an electrophotographic belt capable of implementing a stable formation of a high quality electrophotographic image even in a case where the electrophotographic belt is applied to an electrophotographic image forming apparatus in which the number of power supplies for transfer is reduced.

Another aspect of the present disclosure is directed to providing an electrophotographic image forming apparatus capable of stably forming a high quality electrophotographic image even in a case where the number of power supplies for transfer is reduced.

According to an aspect of the present disclosure, there is provided an endless shaped electrophotographic belt including: an endless shaped base layer containing a polyester resin; and an electro-conductive layer covering an inner surface of the base layer, the electro-conductive layer containing an electro-conductive particle and a binder resin, and the binder resin containing a polyester resin having at least two monomer units of phthalic acids selected from the group consisting of terephthalic acid, orthophthalic acid and isophthalic acid.

According to another aspect of the present disclosure, there is provided an electrophotographic image forming apparatus including: toner image carrying members; an intermediate transfer belt onto which a toner image is primarily transferred from each of the toner image carrying members; a current supply member in contact with the intermediate transfer belt; and a power supply that applies a voltage to the current supply member, in which the toner image is primarily transferred onto the intermediate transfer belt from the toner image carrying member by flowing a current in a circumferential direction of the intermediate transfer belt through the application of the voltage from the power supply to the current supply member, and the intermediate transfer belt is the above-mentioned electrophotographic belt.

Further features of the present disclosure will become apparent from the following description of exemplary embodiments with reference to the attached drawings.

DESCRIPTION OF THE EMBODIMENTS

The present inventors have conducted have studied to obtain an electrophotographic belt including an electro-conductive layer having excellent adhesion to a base layer even when the electro-conductive layer contains a large amount of electro-conductive particles. As a result, the present inventors found that when a polyester resin having at least two monomer units of phthalic acids selected from the group consisting of terephthalic acid, orthophthalic acid and isophthalic acid is used as a binder resin in an electro-conductive layer, adhesion of the electro-conductive layer containing an electro-conductive particle to a base layer is effectively increased.

That is, it is considered that, since the electro-conductive layer contains a large amount of electro-conductive particles, many electro-conductive particles are also present on a side of a surface of the electro-conductive layer facing the base layer. Thus, an interaction between a resin in the electro-conductive layer and a resin in the base layer may become insufficient, and as a result of that, the adhesion of the electro-conductive layer to the base layer is reduced.

In order to increase the adhesion of the electro-conductive layer to the base layer without reduction in the content of the electro-conductive particle in the electro-conductive layer, it is considered effective to further increase the interaction between the resin in the electro-conductive layer and the resin in the base layer.

As to the polyester resin having at least two monomer units of phthalic acids selected from the group consisting of terephthalic acid, orthophthalic acid and isophthalic acid, it has the two monomer units of phthalic acids having different structures in a molecule, and therefore, polymer chains of the polyester resin are difficult to be arranged, and crystallinity thereof is low. From this reason, it is considered that the interaction between the polyester resin in the electro-conductive layer and the resin in the base layer is increased at an interface therebetween, and as a result, the adhesion of the electro-conductive layer to the base layer is considered to be increased.

<Electrophotographic Belt>

Hereinafter, an electrophotographic belt according to the present embodiment is described in detail.

Figure 1A:
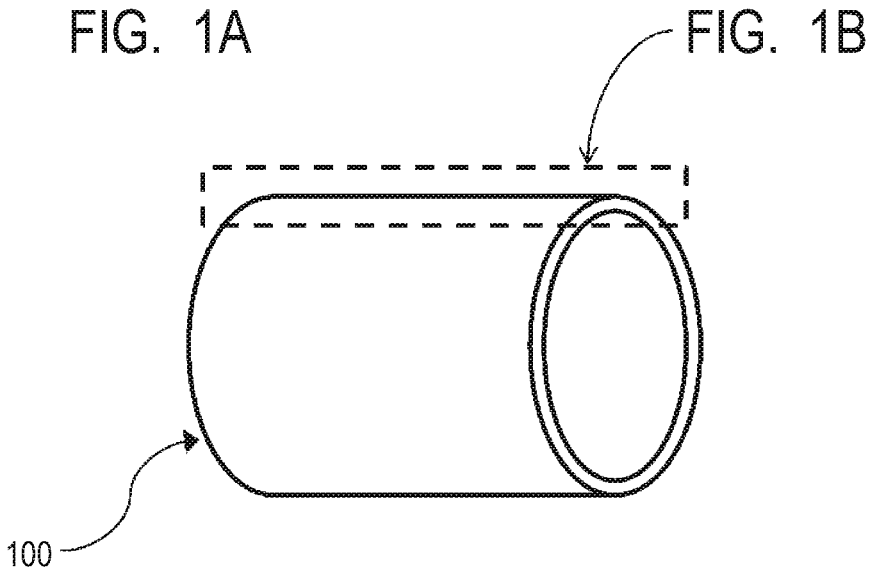
FIG. 1A is a schematic perspective view illustrating an endless shaped electrophotographic belt according to an embodiment of the present disclosure.
Figure 1B:
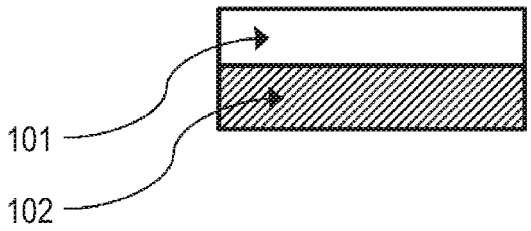
FIG. 1B is an enlarged view of an axial section of FIG. 1A.

FIG. 1A is a perspective view of an endless shaped electrophotographic belt. FIG. 1B is an enlarged view of an axial section of FIG. 1A. In an electrophotographic belt 100 illustrated in each of FIG. 1A and FIG. 1B, an electro-conductive layer 102 is covering an inner surface of a base layer 101, and the electro-conductive layer 102 is exposed to an inner surface of the electrophotographic belt. In addition, although not illustrated in the drawings, the outermost layer in contact with a photosensitive drum or another member may also be provided on the base layer 101.

A voltage maintenance element such as a Zener diode is brought into contact with the electro-conductive layer 102 illustrated in each of FIG. 1A and FIG. 1B via a member in contact with the electro-conductive layer, such that it is possible to make a potential of the electro-conductive layer constant. As a result, it enables to use an electrophotographic belt that can flow a predetermined current to the entire photosensitive drum via the electro-conductive layer and can be used in an image forming apparatus capable of implementing not only a secondary transfer but also a primary transfer with one transfer power supply, as disclosed in Japanese Patent Application Laid-Open No. 2018-036624.

The electrophotographic belt has an endless belt shape so as to be used while being stretched by rollers. The endless belt shape refers to, for example, a shape obtained by connecting a sheet or film shaped composition into a cylindrical shape, or a shape that is stretched by rollers and can be rotated. Among the endless belt shapes, a seamless shape with no seam is preferable, from the viewpoint of reduction in thickness unevenness of a belt or the like.

Since the electrophotographic belt is used in the miniaturized and cost reduced image forming apparatus, it is preferable that a volume resistivity of the electrophotographic belt measured in a normal temperature and normal humidity environment (temperature of 23° C. and humidity of 50%) is in a range of $1\times10^{9}$ to $1\times10^{10}$ Ω·cm.

In addition, a surface resistivity of an inner surface of the electrophotographic belt is preferably lower than that of an outer surface of the electrophotographic belt, and the measured surface resistivity of the inner surface of the electrophotographic belt is preferably in a range of $4.0\times10^{6}$Ω/□ or lower. When the surface resistivity is high, a transfer voltage required to perform a primary transfer of a toner image on a photosensitive drum onto a transfer belt may be insufficient, and thus an image defect such as transfer blank may occur.

Next, constituent materials and formation methods for layers of the electrophotographic belt are described in detail. It should be noted that a production method of the electrophotographic belt is not particularly limited.

[Electro-Conductive Layer]

The electro-conductive layer contains an electro-conductive particle and a binder resin.

A surface resistivity of the electro-conductive layer measured at an outermost surface opposed to a surface facing the base layer of the electro-conductive layer while applying a voltage of 10 V, may preferably be $4.0\times10^{6}$Ω/□ or lower, and more preferably $1.0\times10^{6}$Ω/□ or lower. A lower limit of the surface resistivity is not particularly limited. When the surface resistivity is within the above range, it is possible to supply a primary transfer current equivalent to that of the primary transfer having transfer power supplies according to the related art to each photosensitive drum. The surface resistivity is a value measured by a method of measuring a surface resistivity of an electro-conductive layer to be described later.

A thickness of the electro-conductive layer is preferably 0.05 μm or more and 10 μm or less, and more preferably 0.1 μm or more and 5 μm or less, from the viewpoint of flexing resistance. In consideration of the thickness, as the binder resin, it is preferable to use a binder resin that can be dissolved in a solvent and can form a thin layer containing the binder resin or a thin layer containing a raw material of the binder resin.

It is preferable that the electro-conductive layer has an average hardness of 0.10 GPa or more in a region of 10% to 20% of the electro-conductive layer in a thickness (film thickness) direction from the outermost surface opposed to a surface facing the base layer of the electro-conductive layer, the average hardness being measured by a nanoindentation method using a Berkovich indenter. A region that is in the vicinity of the outermost surface and corresponds to less than 10% of the thickness of the electro-conductive layer is easily affected by a measurement environment such as vibration of an indenter. In addition, a region corresponding to more than 20% of the thickness of the electro-conductive layer is easily affected by the base layer. Therefore, an average hardness in the region corresponding to 10% to 20% of the thickness of the electro-conductive layer is calculated except for these regions. When a hardness of the electro-conductive layer is defined as the average hardness in the region, and the average hardness is 0.10 GPa or more, it is possible to suppress physical degradation such as wear or abrasion due to rubbing with another sliding member (for example, a transfer roller or the like) mounted on the electrophotographic apparatus.

An upper limit of the average hardness in the region of the electro-conductive layer is not particularly limited. However, the average hardness is preferably 0.50 GPa or less because physical damage to the sliding member mounted on a general electrophotographic apparatus can be suppressed within this range.

That is, the average hardness in the region of the electro-conductive layer is more preferably 0.10 GPa or more and 0.50 GPa or less. The average hardness is still more preferably 0.13 GPa or more and 0.40 GPa or less and particularly preferably 0.15 GPa or more and 0.30 GPa or less. As a method of increasing the hardness, for example, a method of increasing a molecular weight of the polyester resin or a method of adding a filler or crosslinking agent with high hardness or a curable resin can be used.

(Electro-Conductive Particle)

An electronic electro-conductive agent can be used as the electro-conductive particle used in the electro-conductive layer.

Examples of the electronic electro-conductive agent include carbon black, graphite, carbon nanotube (hereinafter, referred to also as "CNT"), a carbon micro-coil, graphene, zinc oxide, zinc antimonate, tin oxide, tin-doped indium oxide (ITO), and antimony-doped tin oxide (ATO).

Furthermore, another example of the electronic electro-conductive agent includes an electro-conductive polymer such as polyaniline, polypyrrole, or polythiophene.

Among them, a high electro-conductive carbon black such as Ketjen Black (registered trademark) having high electro-conductivity is preferable.

A content of the carbon black in the electro-conductive layer is preferably 6 mass % or more, from the viewpoint of the surface resistivity of the electro-conductive layer. In addition, the content of the carbon black in the electro-conductive layer is preferably 15 mass % or less, from the viewpoint of suppressing physical degradation such as crack or wear due to rubbing with another sliding member (for example, a transfer roller, a stretching roller, or the like). That is, the content of the carbon black in the electro-conductive layer is preferably in a range of 6 mass % or more and 15 mass % or less, and is more preferably in a range of 9 mass % or more and 13 mass % or less. Here, the content of the carbon black can be calculated from the amount of residue obtained by subjecting the electro-conductive layer to a pyrolysis reaction. Among materials constituting the electro-conductive layer, carbon black has the highest pyrolysis temperature. Therefore, a sample of the electro-conductive layer that is cut off from the electrophotographic belt and weighed is treated at a temperature that is equal to or higher than a decomposition temperature of the binder resin and is lower than a decomposition temperature of the carbon black in an air atmosphere with a thermogravimetric analyzer (TGA) to promote a pyrolysis reaction. As a result, the content thereof can be calculated. As specific conditions, a temperature is raised up to 500° C. at a temperature rising rate of 20° C./min and then held for several hours to promote a pyrolysis reaction other than that of the carbon black. When a weight reduction rate is 1%/hr or less, it is possible to determine that the pyrolysis reaction is completed. In addition, the content of the carbon black may be calculated from the amount of carbon black added at the time of forming the electro-conductive layer.

(Binder Resin)

The binder resin used in the electro-conductive layer contains a polyester resin having at least two monomer units of phthalic acids selected from the group consisting of terephthalic acid, orthophthalic acid and isophthalic acid.

Examples of the binder resin include a copolymer having an ethylene terephthalate unit and an ethylene orthophthalate unit and a copolymer having an ethylene terephthalate unit and an ethylene isophthalate unit. In addition, another example of the binder resin includes a copolymer having an ethylene orthophthalate unit and an ethylene isophthalate unit. These copolymers may be both block and random copolymers. In addition, two or more kinds of copolymers may also be used as a blended and alloyed mixture.

As a result, since polyesters having chemical structures different from each other are mixed in the electro-conductive layer, the electro-conductive layer has very high amorphousness. The chemical structure of the polyester resin can be identified by extracting the polyester from the electro-conductive layer by an adequate method such as dissolution in a solvent to isolate the polyester, by using pyrolysis GC/MS, IR, NMR, or an elemental analysis.

The electro-conductive layer may also contain other additives in a range in which the effect of the present embodiment is not impaired, in addition to the binder resin. Specifically, as the additives, the followings can be included: molybdenum disulfide, boron nitride, silicon nitride, layered clay mineral, a silicone particle, a fluorine resin particle, silicone oil, fluorine oil, perfluoropolyether, a crystallization control agent, a crosslinking agent, and the like. These additives may be used alone or in combination of two or more kinds thereof. It is preferable that a copolymer of a polyester and urethane (polyester urethane resin) is formed by adding both a raw material of the polyester resin and a crosslinking agent such as diisocyanate, from the viewpoint of increasing the hardness of the electro-conductive layer.

A glass transition temperature (Tg) of the binder resin used in the electro-conductive layer is preferably higher than 60° C. from the viewpoint of heat resistance. In a case where the Tg is 60° C. or lower, when printing is performed in a high temperature environment or a temperature in the image forming apparatus is raised during continuous printing, the electro-conductive layer softens and thus fuses with a member in contact with the electro-conductive layer, such as a transfer roller, which may cause image defects. The Tg of the binder resin can be calculated by separating the resin from the electro-conductive layer, and then observing a shift in endothermic peak or baseline during temperature rise with a differential scanning calorimeter (DSC).

(Method of Forming Electro-Conductive Layer)

In consideration of the thickness of the electro-conductive layer, as the polyester resin in the electro-conductive layer, it is preferable to use a polyester resin that can be dissolved in a solvent to be applied. The method of forming an electro-conductive layer includes, for example, applying a coating film of a coating material for electro-conductive layer formation containing a polyester resin, a solvent for dissolving the polyester resin, and carbon black to the base layer to form an electro-conductive layer. As the polyester resin, a polyester resin that can be obtained by performing transesterification and polycondensation on raw materials such as dicarboxylic acid and diol, or a commercially available polyester resin-containing coating material can be used. Specifically, methyl ethyl ketone, methyl isobutyl ketone, or cyclohexanone can be used as the solvent. In addition, an additive such as a leveling agent can be added to the coating material for electro-conductive layer formation, if necessary. As the leveling agent, a known leveling agent can be adequately selected and used. The obtained coating material for electro-conductive layer formation is applied to the inner surface of an endless belt shaped base layer by a coating method such as dip coating, spray coating, ring coating, or roll coating. Thereafter, the solvent is dried and removed, and then an electro-conductive layer as a coating film can be formed.

[Outermost Layer]

The outermost layer can be adequately provided on an outer surface of the base layer, in order for adhesion with another contact member such as a photosensitive drum or a cleaning blade, or blocking prevention. The outermost layer can contain a resin.

The resin is not particularly limited, but, in consideration of a thickness of the outermost layer, a resin that is soluble in a solvent and can be formed as a thin layer is preferable. For example, soluble polyimide, a curable urethane resin, or an acrylic resin can be used as the resin. Among them, an acrylic resin is preferable from the viewpoint of rub resistance and hardness.

In addition, a filler particle or a lubricant as an additive can be added to the outermost layer, in addition to the resin. Specifically, as the additives, the followings can be included: Examples of the additive include alumina, titania, silica, zirconia, zinc oxide, zinc antimonate, tin oxide, tin-doped indium oxide (ITO), antimony-doped tin oxide (ATO), molybdenum disulfide, boron nitride, silicon nitride, and layered clay mineral. Other examples of the additive include a silicone particle, a fluorine resin particle such as a polytetrafluoroethylene (PTFE) particle, carbon black, graphite, carbon nanotube, a carbon micro-coil, and graphene. In addition, examples of the additive include silicone oil, fluorine oil, and perfluoropolyether. Among them, a PTFE particle is preferable from the viewpoint of low friction. These additives may be used alone or in combination of two or more kinds thereof.

In a case where a PTFE particle is used, a content of the PTFE particle in the outermost layer is preferably 5 parts by mass or more and 60 parts by mass or less, and is more preferably 10 parts by mass or more and 50 parts by mass or less, with respect to 100 parts by mass of the resin in the outermost layer. When the content of the PTFE particle is within the above range, adhesion with another contact member or blocking can be prevented. In addition, an electro-conductive agent, a curing agent, an antioxidant, an ultraviolet absorber, a pH adjuster, a crosslinking agent, a pigment, or the like can be added to the outermost layer, if necessary.

Furthermore, unevenness may be formed on a surface of the outermost layer. By forming the unevenness, a contact area with another contact member can be reduced, and a friction resistance can be further reduced, in addition to the effect by the additive such as the filler particle or the lubricant. A method of forming unevenness is not particularly limited, but the unevenness can be formed by rotating an electrophotographic belt having the outermost layer supported by a core or the like in a circumferential direction while being in contact with a wrapping film containing an abrasive grain, and polishing a surface of the outermost layer. In addition, a method such as imprint processing in which a mold processed into a desired shape in advance is brought into contact with the surface of the outermost layer can also be used. A thickness of the outermost layer is preferably 0.05 μm or more and 10 μm or less, and more preferably 0.1 μm or more and 5 μm or less, from the viewpoint of crack or flexing resistance.

[Base Layer]

The base layer has an endless shape. In addition, the base layer contains a polyester resin as a binder resin. As the base layer, for example, a layer obtained by connecting a semi electro-conductive film into a cylindrical shape, the semi electro-conductive film being obtained by allowing a resin including a polyester resin to contain an electro-conductive agent, or a cylindrical seamless belt can be used.

(Resin)

The polyester resin can be obtained by polycondensation of a dicarboxylic acid component and a dihydroxy component, polycondensation of an oxycarboxylic acid component or a lactone component, or polycondensation using these components. The polyester resin may be a homopolyester or a copolyester.

Examples of the dicarboxylic acid component can include aromatic dicarboxylic acid, alicyclic dicarboxylic acid, aliphatic dicarboxylic acid, and derivatives of these dicarboxylic acids. An example of the aromatic dicarboxylic acid can include aromatic dicarboxylic acid having 8 or more and 16 or less carbon atoms (C8-C16) in a molecule. Specific examples of the aromatic dicarboxylic acid can include terephthalic acid, isophthalic acid, phthalic acid, naphthalenedicarboxylic acid such as 2,6-naphthalenedicarboxylic acid, diphenyl dicarboxylic acid, diphenyl ether dicarboxylic acid, diphenyl methane dicarboxylic acid, and diphenyl ethane dicarboxylic acid. An example of the alicyclic dicarboxylic acid can include C4-C10 cycloalkanedicarboxylic acid such as cyclohexanedicarboxylic acid. An example of the aliphatic dicarboxylic acid can include C4-C12 aliphatic dicarboxylic acid such as succinic acid, adipic acid, azelaic acid, or sebacic acid. Examples of the derivatives of these dicarboxylic acids can include derivatives capable of producing an ester (for example, a lower alkyl ester such as a dimethyl ester, anhydride, and an acid halide such as acid chloride). These dicarboxylic acid components can be used alone or in combination of two or more kinds thereof. The dicarboxylic acid component is preferably aromatic dicarboxylic acid, and more preferably terephthalic acid, isophthalic acid, or naphthalenedicarboxylic acid, from the viewpoint of crystallinity and heat resistance.

Examples of the dihydroxy component can include aliphatic diol, alicyclic diol, and aromatic diol. An example of the aliphatic diol can include C2-C10 alkylene diol such as ethylene glycol, propylene glycol, 1,3-butanediol, 1,4-butanediol, neopentyl glycol, or hexanediol. An example of the alicyclic diol can include C4-C12 alicyclic diol such as cyclohexanediol or cyclohexanedimethanol. An example of the aromatic diol can include C6-C20 aromatic diol such as hydroquinone, resorcin, dihydroxybiphenyl, naphthalene diol, dihydroxydiphenyl ether, or 2,2-bis(4-hydroxyphenyl) propane (bisphenol A).

Another example thereof can include an alkylene oxide adduct of the aromatic diol (for example, C2-C4 alkylene oxide adduct of bisphenol A). Still another example thereof can include polyoxyalkylene glycol (for example, polyoxy C2-C4 alkylene glycol such as diethylene glycol, polyoxyethylene glycol, polyoxypropylene glycol, or polytetramethylene ether glycol). These dihydroxy components may also be derivatives capable of producing an ester (for example, an alkyl group, an alkoxy group, a halogen substituent, or the like). These dihydroxy components can be used alone or in combination of two or more kinds thereof. Among these dihydroxy components, alkylene diol (in particular, C2-C4 alkylene diol) or alicyclic diol is preferably used, from the viewpoint of crystallinity and heat resistance.

As the oxycarboxylic acid component, the followings can be included: oxycarboxylic acids such as oxybenzoic acid, oxynaphthoic acid, diphenylene oxycarboxylic acid, and 2-hydroxypropanoic acid, and derivatives of these oxycarboxylic acids. These oxycarboxylic acid components can be used alone or in combination of two or more kinds thereof.

The lactone component includes C3-C12 lactone such as propiolactone, butyrolactone, valerolactone, or caprolactone (for example, ε-caprolactone or the like). These lactone components can be used alone or in combination of two or more kinds thereof.

In addition, a polyfunctional monomer may also be used, within a range in which crystallinity and heat resistance are maintained. Examples of the polyfunctional monomer can include polycarboxylic acid such as trimellitic acid, trimesic acid, or pyromellitic acid, and polyhydric alcohol such as glycerin, trimethylolpropane, trimethylolethane, or pentaerythritol. A polyester having a branched or crosslinked structure produced by using the polyfunctional monomer can also be used.

As the polyester resin, a polyester resin obtained by polycondensing the above components (the dicarboxylic acid component, the dihydroxy component, the oxycarboxylic acid component, the lactone component, or any of these components) can be used. In addition, the polyester resin is preferably at least one selected from polyalkylene terephthalate, polyalkylene naphthalate, and a block or random copolymer of polyalkylene terephthalate and polyalkylene isophthalate, from the viewpoint of crystallinity and heat resistance. Examples of the copolymer can include a block copolymer and a random copolymer. The number of carbon atoms of alkylene in each of polyalkylene terephthalate, polyalkylene isophthalate, and polyalkylene naphthalate is preferably 2 or more and 16 or less, from the viewpoint of crystallinity and heat resistance. The polyester resin is more preferably at least one selected from polyethylene terephthalate, a block or random copolymer of polyethylene terephthalate and polyethylene isophthalate, and polyethylene naphthalate.

The polyester resin may be a blended product or an alloy of two or more kinds of components. Specific examples of the polyethylene naphthalate can include the commercially available TN-8050SC (trade name, manufactured by TEIJIN LIMITED) and TN-8065S (trade name, manufactured by TEIJIN LIMITED). Examples of the polyethylene terephthalate can include the commercially available TR-8550 (trade name, manufactured by TEIJIN LIMITED). An example of the copolymer of polyethylene terephthalate and polyethylene isophthalate can include the commercially available PIFG30 (trade name, manufactured by Bell Polyester Products, Inc.).

An intrinsic viscosity of the polyester resin is preferably 1.4 dl/g or less, more preferably 0.3 dl/g or more and 1.2 dl/g or less, and still more preferably 0.4 dl/g or more and 1.1 dl/g or less. When the intrinsic viscosity is 1.4 dl/g or less, reduction in fluidity of the polyester resin during molding can be efficiently prevented. When the intrinsic viscosity is 0.3 dl/g or more, a strength and durability of the electrophotographic belt can be efficiently secured. The intrinsic viscosity of the polyester resin is a value measured by using o-chlorophenol as a diluting solvent for the polyester resin, and setting a concentration of an o-chlorophenol solution of the polyester resin to 0.5 mass % and a temperature to 25° C.

A content of the polyester resin is preferably 50 mass % or more, more preferably 60 mass % or more, and particularly preferably 70 mass % or more, with respect to a total mass of the base layer. When the content of the polyester resin is 50 mass % or more, reduction in durability of the electrophotographic belt can be efficiently prevented.

(Electro-Conductive Agent)

In the base layer, a nonionic or ionic electro-conductive agent can be used as an electro-conductive agent. In addition, a high-molecule type or low-molecule type electro-conductive agent can be used as the electro-conductive agent. For example, as the high-molecule type nonionic electro-conductive agent, polyetheresteramide, polyethylene oxide-epichlorohydrin, or polyetherester can be used. In addition, as the high-molecule type ionic electro-conductive agent, a cationic quaternary ammonium group-containing acrylate polymer or anionic polystyrenesulfonic acid can be used. In addition, as the low-molecule type nonionic electro-conductive agent, a derivative having an ether group or a derivative having an ether ester can be used. As the low-molecule type ionic electro-conductive agent, primary to tertiary cationic ammonium salts or a quaternary cationic ammonium salt and derivatives thereof, or an anionic carboxylic acid salt, sulfuric acid ester salt, sulfonic acid salt, or phosphoric acid ester salt and derivatives thereof can be used. These high-molecule type or low-molecule type electro-conductive agents can be used alone or in combination of two or more kinds thereof. Among them, a quaternary ammonium salt, a sulfonic acid salt, or polyetheresteramide is adequately used, from the viewpoint of heat resistance or electro-conductivity.

In addition, additives such as a plasticizer, an antioxidant, a decomposition inhibitor, a crystallization control agent, a roughness adjuster, a crosslinking agent, a pigment, a filler, and an elastomer can be added to the base layer, if necessary.

(Method of Forming Base Layer)

The base layer can be formed by the following methods. In a case where a thermoplastic resin is used as a resin, an ionic surfactant which is an electro-conductive agent, a resin, and, if necessary, an additive are mixed with each other, and then the mixture is melted and kneaded using a biaxial kneader or the like, thereby preparing semi-electro-conductive pellets. Next, a semi-electro-conductive film can be obtained by melting and extruding the pellets into a sheet shape, a film shape, or a seamless belt shape. In addition, the pellets can be molded by thermal press or injection molding, a formed preform is subjected to stretch blow, and thus a semi-electro-conductive film can be obtained. A thickness of the base layer is preferably 20 μm or more and 500 μm or less, and more preferably 30 μm or more and 150 μm or less.

As an electric resistance of the thus-obtained base layer, a volume resistivity of the base layer when a voltage of 100 V is applied is preferably $1.0\times10^{8}$ Ω·cm or higher and $1.0\times10^{12}$ Ω·cm or lower. In addition, a surface resistivity of the base layer is preferably $1.0\times10^{8}$Ω/□ or higher and $1.0\times10^{12}$Ω/□ or lower. By controlling the electric resistance to be within a semi-electro-conductive range thereof, it is possible to suppress transfer image defects caused by an insufficient transfer voltage due to a low temperature environment or charging up during continuous driving.

<Electrophotographic Apparatus>

Next, an example in which the electrophotographic belt according to the present disclosure is used in an electrophotographic apparatus as an intermediate transfer belt is described with reference to FIG. 2.

Figure 2:
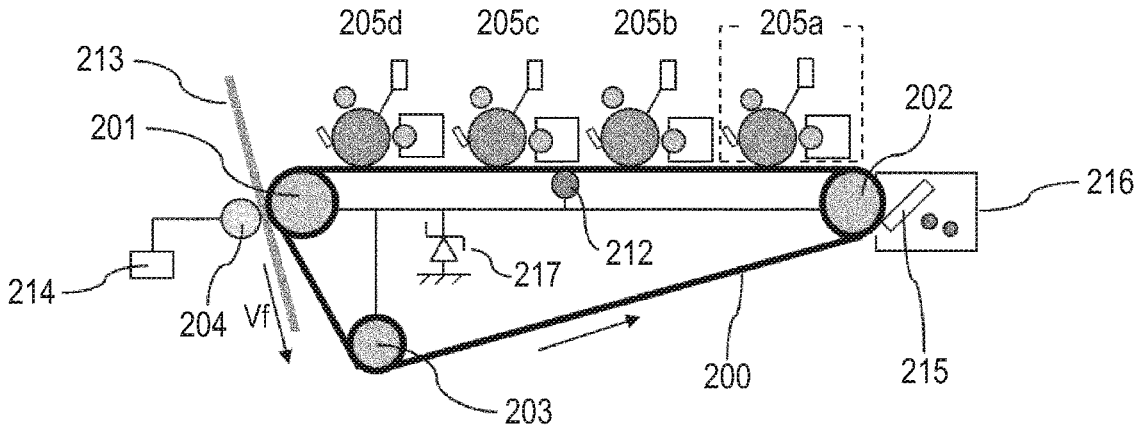
FIG. 2 is a schematic view of an electrophotographic image forming apparatus according to another embodiment of the present disclosure.

FIG. 2 is a schematic view of a color electrophotographic apparatus using an intermediate transfer belt 200 according to the present disclosure. The intermediate transfer belt 200 is supported by three rollers of a driving roller/secondary transfer facing roller 201 and stretching rollers 202 and 203. The driving roller/secondary transfer facing roller 201 is provided with a rubber layer having a high friction resistance formed on a surface layer thereof so as to drive the intermediate transfer belt 200. The rubber layer has electro-conductivity with a volume resistivity of $1.0\times10^{5}$ Ω·cm or lower. In addition, the driving roller/secondary transfer facing roller 201 forms a secondary transfer portion together with a secondary transfer roller 204 with the intermediate transfer belt 200 disposed therebetween. The stretching roller 202 is provided with a rubber layer, and the rubber layer has electro-conductivity with a volume resistivity of $1.0\times10^{5}$ Ω·cm or lower. In addition, a metal roller can be used as the stretching roller 203. The secondary transfer roller 204 is pressed against the driving roller/secondary transfer facing roller 201 with the intermediate transfer belt 200 disposed therebetween. As the secondary transfer roller 204, an elastic roller having a volume resistivity of $1.0\times10^{7}$ Ω·cm or higher and $1.0\times10^{9}$ Ω·cm or lower can be used. The stretching rollers 202 and 203 and the secondary transfer roller 204 are rotated while following the intermediate transfer belt 200.

The electrophotographic apparatus according to the present disclosure includes: a photosensitive drum that forms a toner image; an intermediate transfer belt that is in contact with the photosensitive drum so as to allow the toner image to be primarily transferred thereon; and a secondary transfer member that faces the intermediate transfer belt and performs a secondary transfer of the toner image onto a recording medium. The secondary transfer member has a power supply capable of applying a voltage for the secondary transfer. As the intermediate transfer belt, the electrophotographic belt according to the present disclosure can be used. The power supply applies a voltage to the secondary transfer member, such that a current flows to the photosensitive drum from the secondary transfer member via the intermediate transfer belt, thereby performing the primary transfer of the toner image from the photosensitive drum to the intermediate transfer belt. As such, in the present disclosure, the power supply for the primary transfer and the power supply for the secondary transfer are used in common.

Figure 3:
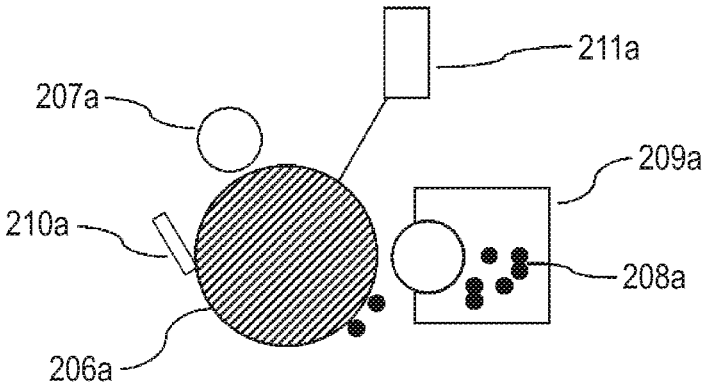
FIG. 3 is an enlarged schematic view of an image forming unit of FIG. 2.

The electrophotographic apparatus according to the present disclosure is described in more detail. The electrophotographic apparatus according to the present disclosure includes image forming units of an image forming unit 205*a* that forms an image with a yellow color, an image forming unit 205*b* that forms an image with a magenta color, an image forming unit 205*c* that forms an image with a cyan color, and an image forming unit 205*d* that forms an image with a black color. Hereinafter, the image forming unit 205*a* is described in detail by way of example. FIG. 3 is an enlarged schematic view of the image forming unit 205*a*. The image forming unit 205*a* includes a photosensitive drum 206*a* which is an image carrying member, and is rotatably driven at a predetermined process speed. A charging roller 207*a* which is a charging member, a developing member 209*a* storing toner 208*a*, and a drum cleaning member 210*a* are arranged around the photosensitive drum 206*a*. In addition, an exposing member 211*a* is arranged around the photosensitive drum 206*a* and between the charging roller 207*a* and the developing member 209*a*. The photosensitive drum 206*a* is charged by the charging roller 207*a*, and the charged electrostatic charge image carrying member is exposed by the exposing member 211*a*, thereby forming an electrostatic latent image (toner image). Thereafter, the electrostatic latent image is developed by toner 208*a* subjected to triboelectric charging in the developing member 209*a*, and the developed electrostatic latent image is transferred onto the intermediate transfer belt 200 disposed at a position facing each image forming unit by a primary transfer voltage (hereinafter, referred to as a "primary transfer"). Similarly, in each of the image forming units 205*b*, 205*c*, and 205*d*, a primary transfer is performed in synchronization with the rotation of the intermediate transfer belt 200, thereby forming a four-color combined toner image. In this case, it is preferable that at least one metal roller 212 that is a primary transfer facing member is provided between the image forming units 205*b* and 205*c* via the intermediate transfer belt 200 at a position facing the image forming units. A primary transfer portion is formed by the metal roller 212 pressing the intermediate transfer belt 200 against the image forming units that face the intermediate transfer belt 200, such that a primary transfer width (nip) can be widened and stabilized.

A recording medium 213 such as paper is fed to a position that is located on a downstream side of a position of the fourth image forming unit 205*d* disposed on the intermediate transfer belt 200. At the same position, the secondary transfer roller 204 (secondary transfer member) is disposed. A gap formed by the intermediate transfer belt 200 and the secondary transfer roller 204 and the vicinity thereof at a portion where the toner image on the intermediate transfer belt 200 is transferred onto the recording medium are referred to as a secondary transfer portion. As illustrated in FIG. 2, the secondary transfer portion is preferably configured to have a nip portion between the driving roller/secondary transfer facing roller 201 and the secondary transfer roller 204. When a non-image portion immediately before the toner combined image formed on the intermediate transfer belt 200 reaches the secondary transfer portion, a voltage having polarity opposite to that of the toner is applied from a voltage power supply 214 supplying a current to the secondary transfer roller 204. In addition, when the recording medium 213 passes through the secondary transfer portion in a direction of the arrow Vf of FIG. 2, the four-color combined toner image on the intermediate transfer belt 200 is collectively transferred onto the recording medium 213. This transfer is referred to as a "secondary transfer". The recording medium 213 subjected to the secondary transfer is subjected to a fixing process by a fixing unit (not illustrated), thereby forming a color image. On the other hand, the toner remaining on the intermediate transfer belt 200 without being subjected to the secondary transfer is scrapped by a cleaning blade 215 that comes into contact with a surface of the belt where the stretching roller 202 is disposed at a predetermined timing, and then is recovered to a waste toner box 216. By doing so, the surface of the intermediate transfer belt 200 returns to the initial state.

In the electrophotographic apparatus according to the present disclosure, a transfer voltage required for the primary transfer can also be obtained from the voltage power supply 214 in addition to the transfer voltage required for the secondary transfer. The intermediate transfer belt 200 of the present disclosure includes, for example, an electro-conductive layer provided at an inner surface of the belt. In addition, as illustrated in FIG. 2, the metal roller 212 in contact with the inner surface of the intermediate transfer belt 200 is connected to a Zener diode 217 which is a constant voltage element, and is grounded. Therefore, a potential of the electro-conductive layer of the intermediate transfer 200 belt becomes constant in a circumferential direction by the voltage applied from the voltage power supply 214. As a result, potential differences between the photosensitive drums of the image forming units 205*a*, 205*b*, 205*c*, and 205*d* and the intermediate transfer belt 200 are substantially equal, and the currents flowing to the photosensitive drums are also substantially equal, and thus it is possible to perform the primary transfer. Since the resistance value of the recording medium itself varies depending on an environmental change such as a temperature or a humidity during image formation, a secondary transfer voltage is preferably changed within a predetermined range. In the electrophotographic apparatus according to the present disclosure, since the metal roller is connected to the Zener diode 217, even in a case where the secondary transfer voltage is changed, for example, the secondary transfer voltage is increased, a current flows when the voltage exceeds a Zener potential. Therefore, the potential of the electro-conductive layer can be constantly maintained, and thus the primary transferability can be stabilized. Specifically, it is preferable that an application voltage of the voltage power supply 214 is 1,000 to 3,500 V, and the Zener potential is 220 to 300 V. According to the present disclosure, by the above transfer configuration, the primary transfer and the secondary transfer can be stably performed by one transfer power supply.

According to an aspect of the present disclosure, it is possible to provide an electrophotographic belt capable of implementing a stable formation of a high quality electrophotographic image even in a case where the electrophotographic belt is applied to an electrophotographic image forming apparatus in which the number of power supplies for transfer is reduced. According to another aspect of the present disclosure, it is possible to provide an electrophotographic image forming apparatus capable of stably forming a high quality electrophotographic image even in a case where the number of power supplies for transfer is reduced.

EXAMPLES

Hereinafter, Examples and Comparative Examples are described.

In the following Examples and Comparative Examples, materials in a coating material may be diluted and dispersed by a solvent, but the amount of each material used (parts by mass) is an amount based on a non-volatile content unless otherwise specified, and means an amount excluding the solvent (volatile component).

In addition, materials used for electro-conductive layers of electrophotographic belts Nos. 1 to 24 according to Examples 1 to 15, Comparative Examples 1 to 8, and Reference Example 1 are shown in Table 1-1. Materials used for base layers of the electrophotographic belts Nos. 1 to 24 according to Examples 1 to 15, Comparative Examples 1 to 8, and Reference Example 1 are shown in Table 1-2. The evaluation results of the electrophotographic belts Nos. 1 to 24 are shown in Table 2.

Example 1

(Formation of Base Layer)

The following raw materials were used for forming a base layer.

Polyethylene naphthalate as polyester resin (trade name: TEONEX TN8050SC, manufactured by THEN LIMITED) (hereinafter, referred to as "PE(1)")

Polyetheresteramide as electro-conductive agent (trade name: TPAE-10HP-10, manufactured by T&K TOKA Corporation) (hereinafter, referred to as "PEEA")

Potassium perfluorobutanesulfonate (trade name: Eftop KFBS, manufactured by Mitsubishi Materials Electronic Chemicals Co., Ltd.) (hereinafter, referred to as "KFBS")

A melting point of PE(1) was 262° C.

The PE(1), PEEA, and KFBS were mixed at a ratio of 80/18/2 (mass %), and then the mixture was melted and kneaded at 290° C. for 5 minutes with a biaxial extrude (trade name: TEX30a, manufactured by The Japan Steel Works, LTD.), thereby obtaining a resin mixture formed of PE(1), PEEA, and KFBS. The obtained resin mixture was pelletized with a cutter (trade name: FAN-CUTTER, manufactured by Hoshi Plastic Co., Ltd.), thereby obtaining pellets of the resin mixture (pellet size: major axis 3 mm×minor axis 2 mm). The obtained pellets were dried at 140° C. for 6 hours.

Next, the pellets obtained by drying the resin mixture were added into a hopper of an injection molding apparatus (trade name: SE180D, manufactured by Sumitomo Heavy Industries, Ltd.). Then, a temperature of a cylinder was set to 290° C., the pellets were melted by stirring with a screw, and the melted pellets were subjected to injection molding in a mold, thereby preparing a test tube shaped preform. The obtained preform was added to a blow molding machine, and blow molding was performed in a blow mold with a mold temperature maintained at 110° C. with a rod and a force of air at a preform temperature of 155° C., an air pressure of 0.3 MPa, and a stretching rod speed of 1,000 mm/s, thereby obtaining a blow bottle. Both ends of the blow bottle were cut off, such that a base layer for an endless shaped electrophotographic belt was cut out. A thickness of the base layer was 70 μm.

(Preparation of Binder Resin for Electro-Conductive Layer)

194 parts by mass of dimethyl terephthalate, 194 parts by mass of dimethyl isophthalate, 239 parts by mass of ethylene glycol, and 38 parts by mass of diethylene glycol were added in an autoclave. Next, 0.2 parts by mass of tetrabutyl titanate as a catalyst was added to the autoclave, and transesterification was allowed to proceed at 190° C. to 220° C. for 5 hours. Next, a temperature was raised up to 280° C. while reducing a pressure of a reaction system up to 0.67 kPa (5 mmHg) over 20 minutes. In addition, a polycondensation reaction was performed at 13.3 Pa (0.1 mmHg) and 280° C. for 60 minutes, and a polyester (1) having monomer units of isophthalic acid and terephthalic acid was obtained. After measurement was performed by DSC, a glass transition temperature of the obtained polyester (1) was 65° C.

(Formation of Electro-Conductive Layer)

MHI black #273 (trade name, manufactured by MIKUNI COLOR LTD.) as high electro-conductive carbon black was mixed with the polyester (1) so that a content thereof became 11 mass %. The obtained mixture was diluted in methyl ethyl ketone so that a solid content concentration thereof became 15 mass %, 0.5 mass % of SYMAC US-270 (trade name, manufactured by TOAGOSEI CO., LTD.) as a leveling agent was added thereto, and then the mixture was stirred with a stirrer, thereby obtaining a coating material for uniform electro-conductive layer formation. The coating material was uniformly applied to an inner surface of the base layer by a spray method, and then dried at 70° C. for 5 minutes. By doing so, an electrophotographic belt No. 1 in which the electro-conductive layer having a thickness of 2 μm was formed on the inner surface of the base layer was obtained. Then, the following evaluations 1 to 3 of the electrophotographic belt No. 1 were carried out.

<Evaluation 1. Measurement of Average Hardness of Electro-Conductive Layer>

A hardness of the electro-conductive layer was measured by using a Berkovich indenter with a microindentation hardness tester (trade name: Nanoindenter G200 type, manufactured by Agilent Technologies, Inc.). A region of 10% to 20% of the electro-conductive layer in a thickness direction from the outermost surface opposed to a surface facing the base layer of the electro-conductive layer was set as a measurement region, and then an average hardness in the region was calculated. The results are shown in Table 2.

<Evaluation 2. Measurement of Resistivity>

A surface resistivity of the electro-conductive layer was measured with a resistivity meter (trade name: Hiresta UP MCP-HT450 type, manufactured by Mitsubishi Chemical Analytech Co., Ltd.) in accordance with Japanese Industrial Standards (JIS) K 6911. For measuring the surface resistivity of the electro-conductive layer, under an environment of a temperature of 23° C. and a relative humidity of 50%, a URS probe was brought into contact with the outermost surface of the electro-conductive layer, a value obtained at an application voltage of 10 V and a measurement time of 10 seconds was defined as a measurement value, four points in a circumferential direction of the electro-conductive layer were measured for each 90° phase, and then an average value of these measurement values was calculated. For measuring a volume resistivity of the electrophotographic belt including the base layer and the electro-conductive layer, under the above environment, a UR probe was brought into contact with an outer surface of the electrophotographic belt, and a value obtained at an application voltage of 100 V and a measurement time of 10 seconds was defined as a measurement value. Four points in a circumferential direction of the electrophotographic belt were measured for each 90° phase, and then an average value of these measurement values was calculated. The results are shown in Table 2. In Table 2, "UNDER" indicates a value equal to or less than a lower limit of the measurement value, which is less than $1.0\times10^5\Omega/\square$.

<Evaluation 3. Peeling and Image Evaluations>

The obtained electrophotographic belt was used as an intermediate transfer belt of the electrophotographic image forming apparatus having the structure illustrated in FIG. 2 to form an electrophotographic image, and then the presence or absence of image defects caused by a secondary transfer was observed.

Plain paper having a letter size (width: 216 mm) (trade name: Business 4200, manufactured by Fuji Xerox Co., Ltd., basis weight: 75 g/m$^2$) was used as paper, and a secondary color image obtained by superimposing two-color toner solid images output in an one side print mode as a print mode was used. Here, the secondary color image refers to an image with 200% of an average concentration of red (R), green (G), and blue (B). 75,000 sheets were output, and 10,000$^{th}$, 30,000$^{th}$, and 75,000$^{th}$ sheets were evaluated. After 75,000 sheets were output, the electrophotographic belt was removed from the image forming apparatus, and then a surface of the electro-conductive layer was observed with visual observation and a loupe with magnification of 20 times. Then, the presence or absence of occurrence of peeling of the electro-conductive layer was evaluated based on the following criteria.

Rank A: Peeling of the electro-conductive layer was not observed with the loupe.

Rank B: Peeling of the electro-conductive layer was not observed with visual observation.

Rank C: Peeling of the electro-conductive layer was observed with visual observation, and transfer blank caused by the peeling was observed on the image.

Rank N: Transfer failure due to an insufficient transfer voltage was caused.

Example 2

A polyester (2) was prepared and an electrophotographic belt No. 2 was obtained in the same manner as that of Example 1, except that in the preparation of the binder resin for the electro-conductive layer of Example 1, dimethyl terephthalate was changed to dimethyl orthophthalate. After measurement was performed by DSC, a glass transition temperature of the obtained polyester (2) was 68° C. The following evaluations 1 to 3 of the obtained electrophotographic belt No. 2 were carried out.

Example 3

A polyester (3) was prepared and an electrophotographic belt No. 3 was obtained in the same manner as that of Example 1, except that in the preparation of the binder resin for the electro-conductive layer of Example 1, 129 parts by mass of dimethyl terephthalate and 129 parts by mass of dimethyl isophthalate were used, and 129 parts by mass of dimethyl orthophthalate was used instead of dimethyl terephthalate and dimethyl isophthalate. After measurement was performed by DSC, a glass transition temperature of the obtained polyester (3) was 66° C. The following evaluations 1 to 3 of the obtained electrophotographic belt No. 3 were carried out.

Example 4

An electrophotographic belt No. 4 was obtained in the same manner as that of Example 1, except that in the formation of the base layer of Example 1, the content of polyethylene naphthalate was changed from 80 mass % to 72 mass %, and a base layer was formed by adding 8 mass % of the commercially available PIFG30 (trade name, manufactured by Bell Polyester Products, Inc.) (hereinafter, referred to as "PE(2)") as a copolymer of polyethylene terephthalate and polyethylene isophthalate. The following evaluations 1 to 3 of the obtained electrophotographic belt No. 4 were carried out.

Examples 5 and 6

Electrophotographic belts Nos. 5 and 6 were obtained in the same manner as that of Example 4, except that in the formation of the electro-conductive layer, the types and contents of electro-conductive particles of the electro-conductive layers were changed as shown in Table 1. As the electro-conductive particle, in Example 5, graphene (trade name: WGNP, manufactured by Bridgestone KBG Co., Ltd.) was used, and in Example 6, zinc antimonite (trade name: CELNAX CX-Z410K, manufactured by Nissan Chemical Corporation) was used, thereby obtaining the electrophotographic belts Nos. 5 and 6. The following evaluations 1 to 3 of the obtained electrophotographic belts Nos. 5 and 6 were carried out.

Example 7

(Formation of Base Layer)

A base layer was formed in the same manner as that of Example 4.

(Preparation of Binder Resin for Electro-Conductive Layer)

To a 2 L four-neck flask equipped with a thermometer, a stirrer, and a Liebig cooling pipe, 287 parts of dimethyl terephthalate, 97 parts of dimethyl isophthalate, 81 parts of ethylene glycol, and 94 parts of neopentyl glycol were added. In addition, 0.2 parts of tetrabutyl titanate (TBT) as a catalyst was added, and the transesterification was allowed to proceed at 190° C. to 230° C. for 3 hours. Next, a temperature was raised to 250° C., and polyemerization was performed under a reduced pressure for 20 minutes, thereby obtaining polyester diol. 100 parts of the obtained polyester diol, 45 parts of methyl ethyl ketone, and 55 parts of toluene were added and uniformly dissolved at 70° C. Next, 30 parts of diphenylmethane diisocyanate was added thereto, a reaction proceeded at 70° C. for 1 hour, and then the reactant was diluted with 50 parts of each of methyl ethyl ketone and toluene. 49 parts of NEWPOL PP-1200 (trade name, manufactured by Sanyo Chemical Industries, Ltd.) as polypropylene glycol was added, after 30 minutes at 70° C., 0.02 parts of dibutyltin dilaurate was added, and then a reaction was allowed to proceed at 70° C. for 2 hours. Next, the reactant was diluted with methyl ethyl ketone and toluene, 3 parts of neopentyl glycol was added, a reaction was allowed to proceed for 2 hours, and then the reactant was diluted with methyl ethyl ketone and toluene, thereby obtaining polyester urethane (1). After measurement was performed by DSC, a glass transition temperature of the obtained polyester urethane (1) was 70° C.

(Formation of Electro-Conductive Layer)

MHI black #273 (trade name, manufactured by MIKUNI COLOR LTD.) as high electro-conductive carbon black was mixed with the polyester urethane (1) so that a content thereof became 11 mass %. The obtained mixture was diluted in methyl ethyl ketone so that a solid content concentration thereof became 15 mass %, 0.5 mass % of SYMAC US-270 (trade name, manufactured by TOAGOSEI CO., LTD.) as a leveling agent was added thereto, and then the mixture was stirred with a stirrer, thereby obtaining a coating material for uniform electro-conductive layer formation. The coating material was uniformly applied to an inner surface of the base layer by a spray method, and then dried at 70° C. for 5 minutes. By doing so, an electrophotographic belt No. 7 in which the electro-conductive layer having a thickness of 2 μm was formed on the inner surface of the base layer was obtained. The following evaluations 1 to 3 of the obtained electrophotographic belt No. 7 were carried out.

Example 8

In the preparation of the binder resin for the electro-conductive layer of Example 7, the polyester urethane (1) was changed to Vylon UR8200 (trade name, manufactured by TOYOBO CO., LTD.) having monomer units of orthophthalic acid and isophthalic acid (hereinafter, referred to as "polyester urethane (2)"). The preparation was performed in the same manner as that of Example 7 except for this, thereby obtaining an electrophotographic belt No. 8. After measurement was performed by DSC, a glass transition temperature of the polyester urethane (2) was 73° C. The following evaluations 1 to 3 of the obtained electrophotographic belt No. 8 were carried out.

Example 9

In the preparation of the binder resin for the electro-conductive layer of Example 7, the polyester urethane (1) was changed to Vylon UR1400 (trade name, manufactured by TOYOBO CO., LTD.) having monomer units of orthophthalic acid and isophthalic acid (hereinafter, referred to as "polyester urethane (3)"). The preparation was performed in the same manner as that of Example 7 except for this, thereby obtaining an electrophotographic belt No. 9. After measurement was performed by DSC, a glass transition temperature of the polyester urethane (3) was 83° C. The following evaluations 1 to 3 of the obtained electrophotographic belt No. 9 were carried out.

Examples 10 to 15

Electrophotographic belts Nos. 10 to 15 were obtained in the same manner as that of Example 9, except that in the preparation of the binder resin for the electro-conductive layer, the content of the electro-conductive particle was changed as in Table 1. The following evaluations 1 to 3 of the obtained electrophotographic belts Nos. 10 to 15 were carried out.

Comparative Example 1

A polyester (4) was prepared and an electrophotographic belt No. 16 was obtained in the same manner as that of Example 4, except that in the preparation of the binder resin for the electro-conductive layer of Example 4, the amount of dimethyl terephthalate was changed from 194 parts to 388 parts without using dimethyl isophthalate. The following evaluations 1 to 3 of the obtained electrophotographic belt No. 16 were carried out.

Comparative Example 2

A polyester (5) was prepared and an electrophotographic belt No. 17 was obtained in the same manner as that of Example 4, except that in the preparation of the binder resin for the electro-conductive layer of Example 4, the amount of dimethyl isophthalate was changed from 194 parts to 388 parts without using dimethyl terephthalate. The following evaluations 1 to 3 of the obtained electrophotographic belt No. 17 were carried out.

Comparative Example 3

A polyester (6) was prepared and an electrophotographic belt No. 18 was obtained in the same manner as that of Example 8, except that in the preparation of the binder resin for the electro-conductive layer of Example 8, the amount of dimethyl orthophthalate was changed from 194 parts to 388 parts without using dimethyl isophthalate. The following evaluations 1 to 3 of the obtained electrophotographic belt No. 18 were carried out.

Comparative Example 4

In the formation of the base layer, PE(1) was changed to polycarbonate (trade name: Panlite K-1300Y (melting point: 250° C.), manufactured by TEIJIN LIMITED), and the thermal melting and kneading temperature was changed to 280° C. An electrophotographic belt No. 19 was obtained in the same manner as that of Comparative Example 1 except for this. The following evaluations 1 to 3 of the obtained electrophotographic belt No. 19 were carried out. In Table 1-2, the polycarbonate used in the present comparative example is abbreviated as "PC".

Comparative Example 5

(Formation of Base Layer)

In formation of a base layer, a polyvinylidene fluoride (PVdF) resin composition containing 2.5 mass % of an ionic electro-conductive agent (tetrabutylammonium hydrogen sulfate, trade name: 98131, manufactured by KOEI CHEMICAL CO., LTD.) (hereinafter, referred to as "IL1") was prepared. The PVdF resin composition was molded by thermal melting and extrusion, thereby producing a sheet-like film having a thickness of 50 μm. The obtained sheet-like film was wound around an outer surface of a cylindrical member twice, and then the cylindrical member around which the sheet-like film was wound was covered with a hollow tubular member. Dimensions and thermal expansion coefficients of the cylindrical member and the tubular member were designed so that a difference between an outer diameter of the cylindrical member and an inner diameter of the tubular member became 100 μm in a heat process at a temperature of 200° C. to be described later. Next, heating was performed at a temperature of 200° C. for 60 minutes, thereby obtaining an endless shaped base layer having a thickness of 100 μm. In Table 1-2, the polyvinylidene fluoride resin composition used for the formation of the base layer according to the present comparative example is abbreviated as "PVdF".

An electrophotographic belt No. 20 was obtained in the same manner as that of Comparative Example 1, except that this base layer was used. The following evaluations 1 to 3 of the obtained electrophotographic belt No. 20 were carried out.

Comparative Example 6

(Formation of Base Layer)

A base layer was formed in the same manner as that of Comparative Example 65.

Preparation and Formation of Binder Resin for Electro-Conductive Layer

Dipentaerythritol hexaacrylate (main component) (hereinafter, referred to as "acryl") (trade name: Aronix M-402, manufactured by TOAGOSEI CO., LTD.) was used as an acrylic monomer, and MHI black #273 (trade name, manufactured by MIKUNI COLOR LTD.) was used as high electro-conductive carbon black. Here, mixing was performed so that a content of the carbon black became 11 mass % with respect to contents of the acryl and the carbon black. The obtained mixture was diluted in methyl ethyl ketone so that a solid content concentration thereof became 15 mass %, 0.5 mass % of SYMAC US-270 (trade name, manufactured by TOAGOSEI CO., LTD.) as a leveling agent was added thereto, and then the mixture was stirred with a stirrer, thereby obtaining a coating material for uniform electro-conductive layer formation.

The coating material was uniformly applied to an inner surface of the base layer by a spray method, and dried at 60° C. for 1 minute to remove a solvent, and then the curing was performed by irradiation with ultraviolet rays. By doing so, an electrophotographic belt No. 22 in which the electro-conductive layer having a thickness of 2 μm was formed on the inner surface of the base layer was obtained. As an ultraviolet ray source, an ultraviolet irradiation apparatus (trade name: UE06/81-3, manufactured by EYE GRAPHICS Co., Ltd.) was used. The ultraviolet rays were irradiated until an integrated light quantity reaches 2,000 mJ/cm$^2$ at a peak brightness of 150 mW/cm$^2$ at a wavelength of 365 nm, thereby performing UV curing of the electro-conductive layer. The following evaluations 1 to 3 of the obtained electrophotographic belt No. 21 were carried out.

Comparative Example 7

An electrophotographic belt No. 22 was obtained in the same manner as that of Comparative Example 6, except that the binder resin was changed from the acryl to polyamide-imide (trade name: VYLOMAX HR-14ET, manufactured by TOYOBO CO., LTD.). The following evaluations 1 to 3 of the obtained electrophotographic belt No. 22 were carried out.

Reference Example 1

An electrophotographic belt No. 23 was obtained in the same manner as that of Example 4, except that in the formation of the electro-conductive layer of Example 4, the electro-conductive particle was not used. The following evaluations 1 to 3 of the obtained electrophotographic belt No. 23 were carried out.

TABLE 1-1

| | | Electro-photographic belt No. | Electro-conductive layer: Binder resin: Type | Monomer unit of phthalic acid: Isophthalic acid | Terephthalic acid | Orthophthalic acid | Electro-conductive particle: Type | Content (mass %) |
|---|---|---|---|---|---|---|---|---|
| Example | 1 | 1 | Polyester (1) | Presence | Presence | — | Carbon black | 11 |
| | 2 | 2 | Polyester (2) | Presence | — | Presence | Carbon black | 11 |
| | 3 | 3 | Polyester (3) | Presence | Presence | Presence | Carbon black | 11 |
| | 4 | 4 | Polyester (1) | Presence | Presence | — | Carbon black | 11 |
| | 5 | 5 | Polyester (1) | Presence | Presence | — | Graphene | 11 |
| | 6 | 6 | Polyester (1) | Presence | Presence | — | Metal oxide | 66 |
| | 7 | 7 | Polyester urethane (1) | Presence | Presence | — | Carbon black | 11 |

TABLE 1-1-continued

| | | Electro-photographic belt No. | Electro-conductive layer: Binder resin: Type | Monomer unit of phthalic acid: Isophthalic acid | Terephthalic acid | Orthophthalic acid | Electro-conductive particle: Type | Content (mass %) |
|---|---|---|---|---|---|---|---|---|
| | 8 | 8 | Polyester urethane (2) | Presence | — | Presence | Carbon black | 11 |
| | 9 | 9 | Polyester urethane (3) | Presence | Presence | — | Carbon black | 11 |
| | 10 | 10 | Polyester urethane (3) | Presence | Presence | — | Carbon black | 5 |
| | 11 | 11 | Polyester urethane (3) | Presence | Presence | — | Carbon black | 6 |
| | 12 | 12 | Polyester urethane (3) | Presence | Presence | — | Carbon black | 9 |
| | 13 | 13 | Polyester urethane (3) | Presence | Presence | — | Carbon black | 13 |
| | 14 | 14 | Polyester urethane (3) | Presence | Presence | — | Carbon black | 15 |
| | 15 | 15 | Polyester urethane (3) | Presence | Presence | — | Carbon black | 17 |
| Comparative Example | 1 | 16 | Polyester (4) | — | Presence | — | Carbon black | 11 |
| | 2 | 17 | Polyester (5) | Presence | — | — | Carbon black | 11 |
| | 3 | 18 | Polyester (6) | — | — | Presence | Carbon black | 11 |
| | 4 | 19 | Polyester (4) | — | Presence | — | Carbon black | 11 |
| | 5 | 20 | Polyester (4) | — | Presence | — | Carbon black | 11 |
| | 6 | 21 | Acryl | — | — | — | Carbon black | 11 |
| | 7 | 22 | Polyamideimide | — | — | — | Carbon black | 11 |
| Reference Example 1 | | 23 | Polyester (1) | Presence | Presence | — | Carbon black | 0 |

TABLE 1-2

| | | Electro-photographic belt No. | Resin 1: Type | Resin 1: Content (mass %) | Resin 2: Type | Resin 2: Content (mass %) | Electro-conductive agent 1: Type | Electro-conductive agent 1: Content (mass %) | Electro-conductive agent 2: Type | Electro-conductive agent 2: Content (mass %) |
|---|---|---|---|---|---|---|---|---|---|---|
| Example | 1 | 1 | PE(1) | 80 | — | 0 | PEEA | 18 | KFBS | 2 |
| | 2 | 2 | PE(1) | 80 | — | 0 | PEEA | 18 | KFBS | 2 |
| | 3 | 3 | PE(1) | 80 | — | 0 | PEEA | 18 | KFBS | 2 |
| | 4 | 4 | PE(1) | 72 | PE(2) | 8 | PEEA | 18 | KFBS | 2 |
| | 5 | 5 | PE(1) | 72 | PE(2) | 8 | PEEA | 18 | KFBS | 2 |
| | 6 | 6 | PE(1) | 72 | PE(2) | 8 | PEEA | 18 | KFBS | 2 |
| | 7 | 7 | PE(1) | 72 | PE(2) | 8 | PEEA | 18 | KFBS | 2 |
| | 8 | 8 | PE(1) | 72 | PE(2) | 8 | PEEA | 18 | KFBS | 2 |
| | 9 | 9 | PE(1) | 72 | PE(2) | 8 | PEEA | 18 | KFBS | 2 |
| | 10 | 10 | PE(1) | 72 | PE(2) | 8 | PEEA | 18 | KFBS | 2 |
| | 11 | 11 | PE(1) | 72 | PE(2) | 8 | PEEA | 18 | KFBS | 2 |
| | 12 | 12 | PE(1) | 72 | PE(2) | 8 | PEEA | 18 | KFBS | 2 |
| | 13 | 13 | PE(1) | 72 | PE(2) | 8 | PEEA | 18 | KFBS | 2 |
| | 14 | 14 | PE(1) | 72 | PE(2) | 8 | PEEA | 18 | KFBS | 2 |
| | 15 | 15 | PE(1) | 72 | PE(2) | 8 | PEEA | 18 | KFBS | 2 |
| Comparative Example | 1 | 16 | PE(1) | 72 | PE(2) | 8 | PEEA | 18 | KFBS | 2 |
| | 2 | 17 | PE(1) | 72 | PE(2) | 8 | PEEA | 18 | KFBS | 2 |
| | 3 | 18 | PE(1) | 72 | PE(2) | 8 | PEEA | 18 | KFBS | 2 |
| | 4 | 19 | PC | 80 | — | — | PEEA | 18 | KFBS | 2 |
| | 5 | 20 | PVdF | 80 | — | — | PEEA | 18 | KFBS | 2 |
| | 6 | 21 | PVdF | 80 | — | — | PEEA | 18 | KFBS | 2 |
| | 7 | 22 | PVdF | 80 | — | — | PEEA | 18 | KFBS | 2 |
| Reference Example 1 | | 23 | PE(1) | 72 | PE(2) | 8 | PEEA | 18 | KFBS | 2 |

TABLE 2

| | | Electro-photographic belt No. | Physical property value Electro-conductive layer: Surface resistivity (Ω/□) | Tg (° C.) | Hardness (GPa) | Evaluation rank: Early stage | 10k sheets | 30k sheets | 75k sheets |
|---|---|---|---|---|---|---|---|---|---|
| Example | 1 | 1 | 2.0E+05 | 65 | 0.14 | A | A | B | B |
| | 2 | 2 | 2.5E+05 | 68 | 0.14 | A | A | B | B |
| | 3 | 3 | 2.9E+05 | 66 | 0.13 | A | A | B | B |
| | 4 | 4 | 2.1E+05 | 65 | 0.14 | A | A | A | B |
| | 5 | 5 | under | 65 | 0.14 | A | A | A | B |

TABLE 2-continued

| | | Electro-photographic belt No. | Physical property value Electro-conductive layer Surface resistivity (Ω/□) | Tg (° C.) | Hardness (GPa) | Evaluation rank Early stage | 10k sheets | 30k sheets | 75k sheets |
|---|---|---|---|---|---|---|---|---|---|
| | 6 | 6 | 1.0E+07 | 65 | 0.16 | A | A | B | B |
| | 7 | 7 | 1.9E+05 | 70 | 0.17 | A | A | A | A |
| | 8 | 8 | 2.7E+05 | 73 | 0.17 | A | A | A | A |
| | 9 | 9 | 2.5E+05 | 83 | 0.19 | A | A | A | A |
| | 10 | 10 | 9.8E+06 | 83 | 0.24 | A | A | A | A |
| | 11 | 11 | 6.1E+06 | 83 | 0.23 | A | A | A | A |
| | 12 | 12 | 4.0E+05 | 83 | 0.21 | A | A | A | A |
| | 13 | 13 | 1.1E+05 | 83 | 0.15 | A | A | A | A |
| | 14 | 14 | under | 83 | 0.11 | A | A | A | B |
| | 15 | 15 | under | 83 | 0.08 | A | A | B | B |
| Comparative Example | 1 | 16 | 3.0E+05 | 71 | 0.14 | A | B | C | — |
| | 2 | 17 | 2.9E+05 | 72 | 0.14 | A | B | C | — |
| | 3 | 18 | 2.9E+05 | 73 | 0.14 | A | B | C | — |
| | 4 | 19 | 3.0E+05 | 71 | 0.14 | A | B | C | — |
| | 5 | 20 | 3.0E+05 | 71 | 0.14 | A | B | C | — |
| | 6 | 21 | 5.5E+05 | 250 | 0.20 | A | B | C | — |
| | 7 | 22 | 9.6E+06 | 250 | 0.14 | A | C | — | — |
| Reference Example 1 | | 23 | 6.4E+11 | 71 | 0.16 | C | N | — | — |

Hereinafter, the evaluation results shown in Table 2 are described.

In the electrophotographic belts Nos. 1 to 15 according to Examples 1 to 15 each containing the polyester resin having at least two monomer units of phthalic acids in the electro-conductive layer, even after the images of 75,000 sheets were output, the peeling of the electro-conductive layer that can be observed with visual observation was not observed. In addition, on the image on 75,000$^{th}$ sheet, transfer blank caused by the peeling of the electro-conductive layer was also not observed. Among the electrophotographic belts, the electrophotographic belt No. 4 according to Example 4 containing the polyester resin (PE(2)) having two types of monomer units of phthalic acids also in the base layer had particularly excellent adhesion between the electro-conductive layer and the base layer. In addition, the peeling of the electro-conductive layer was not observed even in the observation with the loupe after output of the image of 30,000$^{th}$ sheet.

In addition, in the electrophotographic belts Nos. 7 to 13 according to Examples 7 to 13, even after the images of 75,000 sheets were output, the peeling of the electro-conductive layer was not observed in the observation with the loupe, and the adhesion between the electro-conductive layer and the base layer was particularly excellent. It is considered that this results from the fact that these electrophotographic belts use the polyester urethane resin as the binder resin for the electro-conductive layer, and the introduction of a urethane structure contributes to further improving the adhesion of the electro-conductive layer to the base layer.

On the other hand, in the electrophotographic belts Nos. 16 to 22 according to Comparative Examples 1 to 7 each containing the polyester resin having no two types of monomer units of phthalic acids, after the images of 30,000 sheets were output, the peeling of the electro-conductive layer was observed with visual observation. Furthermore, transfer blank caused by the peeling of the electro-conductive layer was observed on the image formed on the 30,000$^{th}$ sheet.

In addition, in the electrophotographic belt No. 23 according to Reference Example 1, since the electro-conductive particle was not contained in the electro-conductive layer, the adhesion of the electro-conductive layer itself to the base layer was excellent. However, since the surface resistivity of the electro-conductive layer was high, transfer failure was observed from the early stage due to the insufficient transfer voltage.

In addition, in the electrophotographic belts Nos. 19 to 22, the types of the resins for the electro-conductive layer and the base layer were changed, but in the peeling evaluation, levels of all the electrophotographic belts were not sufficient.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-092980, filed May 16, 2019, which is hereby incorporated by reference herein in its entirety.

What is claimed is:

1. An endless shaped electrophotographic belt comprising:

an endless shaped base layer containing a polyester resin; and an electro-conductive layer covering an inner surface of the base layer, the electro-conductive layer containing an electro-conductive particle and a binder resin, and the binder resin containing a polyester resin having at least two monomer units of phthalic acids selected from the group consisting of terephthalic acid, orthophthalic acid and isophthalic acid.

2. The electrophotographic belt according to claim 1, wherein the base layer contains an ionic electro-conductive agent.

3. The electrophotographic belt according to claim 1, wherein the electro-conductive particle is an electronic electro-conductive agent.

4. The electrophotographic belt according to claim 1, wherein the electro-conductive particle is carbon black.

5. The electrophotographic belt according to claim 4, wherein a content of the carbon black in the electro-conductive layer is 9 mass % or more and 13 mass % or less.

6. The electrophotographic belt according to claim 1, wherein a surface resistivity of the electro-conductive layer is $4.0\times10^{6}\Omega/\square$ or lower.

7. The electrophotographic belt according to claim 1, wherein the base layer contains a polyester resin having at least two monomer units of phthalic acids selected from the group consisting of terephthalic acid, orthophthalic acid and isophthalic acid.

8. The electrophotographic belt according to claim 1, wherein the polyester resin in the electro-conductive layer is a polyester urethane resin.

9. The electrophotographic belt according to claim 1, wherein the electro-conductive layer has an average hardness of 0.10 GPa or more in a region of 10% to 20% of the electro-conductive layer in a thickness direction from an outermost surface opposed to a surface facing the base layer of the electro-conductive layer, the average hardness being measured by a nanoindentation method using a Berkovich indenter.

10. The electrophotographic belt according to claim 1, wherein a thickness of the base layer is 20 μm or more and 500 μm or less.

11. The electrophotographic belt according to claim 1, wherein a thickness of the electro-conductive layer is 0.05 μm or more and 10 μm or less.

12. An electrophotographic image forming apparatus comprising:

toner image carrying members;

an intermediate transfer belt onto which a toner image is primarily transferred from each of the toner image carrying members;

a current supply member in contact with the intermediate transfer belt; and a power supply that applies a voltage to the current supply member, wherein the toner image is primarily transferred onto the intermediate transfer belt from the toner image carrying member by flowing a current in a circumferential direction of the intermediate transfer belt through the application of the voltage from the power supply to the current supply member, and the intermediate transfer belt is an electrophotographic belt including an endless shaped base layer containing a polyester resin, and an electro-conductive layer covering an inner surface of the base layer, the electro-conductive layer containing an electro-conductive particle and a binder resin, the binder resin containing a polyester resin having at least two monomer units of phthalic acids selected from the group consisting of terephthalic acid, orthophthalic acid and isophthalic acid.

13. The electrophotographic image forming apparatus according to claim 12, wherein the current supply member is in contact with an outer surface of the electrophotographic belt.

* * * * *